US008441189B2

(12) United States Patent
Halfmann et al.

(10) Patent No.: US 8,441,189 B2
(45) Date of Patent: May 14, 2013

(54) DIELECTRIC BARRIER DISCHARGE LAMP WITH DISCHARGE SPACES

(75) Inventors: Helmut Halfmann, Rheinberg (DE); Axel Hombach, Kuerten (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 0 days.

(21) Appl. No.: 12/819,663

(22) Filed: Jun. 21, 2010

(65) Prior Publication Data

US 2010/0327722 A1 Dec. 30, 2010

(30) Foreign Application Priority Data

Jun. 24, 2009 (DE) ..... 10 2009 030 310

(51) Int. Cl.
*H01J 17/44* (2006.01)

(52) U.S. Cl.
USPC ..... 313/607; 313/234

(58) Field of Classification Search ..... 313/607, 313/234, 17, 26
See application file for complete search history.

(56) References Cited

U.S. PATENT DOCUMENTS

| | | | | |
|---|---|---|---|---|
| 4,740,729 | A * | 4/1988 | Chow | 313/493 |
| 5,604,410 | A | 2/1997 | Vollkommer et al. | |
| 6,194,821 | B1 * | 2/2001 | Nakamura | 313/238 |

FOREIGN PATENT DOCUMENTS

| | | |
|---|---|---|
| DE | 10 2007 006 861 | 5/2008 |
| EP | 1 506 567 | 5/2003 |
| GB | 2 451 873 | 2/2009 |
| WO | WO 03/098653 | 11/2003 |
| WO | WO 2004/023518 | 3/2004 |
| WO | WO 2007/085973 | 8/2007 |
| WO | WO 2008/096292 | 8/2008 |

* cited by examiner

*Primary Examiner* — Joseph L Williams
(74) *Attorney, Agent, or Firm* — Cozen O'Connor

(57) ABSTRACT

Two or more separate discharge spaces (8, 9) are provided in the discharge vessel (2) of a dielectric barrier discharge lamp (1), said discharge spaces (8, 9) each being filled with a discharge medium. This provides the possibility of producing radiation with two or more wavelengths which are characteristic of the respectively used discharge media using a single lamp (1).

11 Claims, 1 Drawing Sheet

A-B

DIELECTRIC BARRIER DISCHARGE LAMP WITH DISCHARGE SPACES

RELATED APPLICATIONS

This application claims the priority of German application no. 10 2009 030 310.3 filed Jun. 24, 2009, the entire content of which is hereby incorporated by reference.

FIELD OF THE INVENTION

The invention is related to a dielectric barrier discharge lamp. With this type of lamp, the lamp electrode of one polarity or the electrodes of both polarities are separated from the discharge medium by a dielectric barrier. The dielectric barrier can also be formed by the wall of the discharge vessel, namely if at least one electrode is arranged outside the discharge vessel (outer electrode).

BACKGROUND OF THE INVENTION

This type of lamp is used in particular for ultraviolet (UV) irradiation in processing technology, for example for surface cleaning and activation, photolytics, ozone production, drinking water purification, metal-plating and UV curing. In this context, the term emitter or UV emitter is also conventional. If the discharge vessel has been provided with a layer of phosphor, the UV radiation is converted into light, i.e. visible electromagnetic radiation, which opens up further use possibilities.

Document EP 1 506 567 B1 has disclosed a discharge lamp with a dielectric barrier on one side which has been provided as a UV emitter for processing technology. For this purpose, the discharge vessel 2 is filled with xenon. During the gas discharge, which is preferably operated by means of a pulsed operating method as described in U.S. Pat. No. 5,604,410, so-called excimers are formed. Excimers are excited molecules, for example Xe2*, which emit electromagnetic radiation when returning to the initial, generally unbound state. In the case of Xe2*, the maximum molecular band radiation is approximately 172 nm. In order to produce the dielectric barrier discharge, a first helical electrode 23 is arranged coaxially within the tubular discharge vessel 2. Six strip-shaped outer electrodes 8*a*-8*f* are arranged parallel to one another and with a mutual distance on the outer side of the discharge vessel 2.

One disadvantage is that previous lamps can only emit a characteristic wavelength range, namely corresponding to the lamp fill used, for example xenon. If a further wavelength range is required, for example that of XeCl excimers whose radiation maximum is approximately 308 nm, a corresponding further lamp is required.

SUMMARY OF THE INVENTION

One object of the present invention is to provide improved dielectric discharge lamps.

This and other objects are attained in accordance with one aspect of the invention directed to a dielectric barrier discharge lamp with a discharge vessel, which discharge vessel has at least one first discharge space and one second discharge space, the two discharge spaces being separated from one another, and the first discharge space surrounding a first discharge medium, and the second discharge space surrounding a second discharge medium.

Particularly advantageous configurations are given in the dependent claims.

An embodiment of the invention provides two or more separate discharge spaces in the discharge vessel of the dielectric barrier discharge lamp. This provides the possibility of exciting two or more different discharge media within the discharge vessel in a manner uninfluenced by one another and thereby producing the characteristic radiation of each of the two or more discharge media with only a single dielectric barrier discharge lamp and consequently at the same time and virtually at the same location.

For this purpose, the discharge vessel comprises two or more vessels, which define two or more separate discharge spaces within the discharge vessel. In addition, the discharge vessel preferably has an outer electrode on its outer side and at least one inner electrode arranged within the discharge vessel.

In a preferred embodiment with two separate discharge spaces, the discharge vessel comprises a first vessel and a larger second vessel. The first vessel is arranged within the second vessel. The interior of the first vessel forms the first discharge space. The second discharge space is formed by the space between the first vessel and the second vessel. In addition, a first electrode of a first polarity is arranged within the first vessel and a second electrode of a second polarity is arranged on the outer side or inner side of the wall of the second vessel.

In a preferred embodiment, the dielectric barrier discharge lamp has an elongate shape and therefore defines a lamp longitudinal axis, the two discharge spaces being arranged coaxially with respect to the lamp longitudinal axis. In a preferred configuration, the discharge vessel of the dielectric barrier discharge lamp is substantially tubular. It comprises a first tubular vessel which is sealed in a gas-tight manner and a second tubular vessel which is sealed in a gas-tight manner, said second tubular vessel having a diameter which is larger than the first tubular vessel. The first tubular vessel is arranged coaxially within the second tubular vessel. In addition, the first electrode is arranged in elongate fashion and axially within the first vessel. It can be in the form of a metallic rod, helix or the like, for example. The second electrode should be shaded from the useful radiation of the lamp as little as possible. It is in the form of a helical wire or wire mesh, for example, or consists of a transparent conductive layer, for example ITO or of a plurality of elongate sub-electrodes which are as thin as possible and are arranged parallel to one another and at a mutual distance.

The discharge media are preferably different than one another. This has the advantage that the lamp according to the invention emits the characteristic radiation of each of the discharge media simultaneously. The material for the vessels is selected such that the vessel walls are sufficiently transparent for the respective characteristic radiation. In particular quartz glass is suitable for UV radiation.

In order to produce UV radiation in two different wavelength ranges, it is preferred for one of the two discharge media to comprise xenon and for the other discharge medium to comprise a krypton halide, for example krypton chloride (KrCl), krypton fluoride (KrF) or krypton bromide (KrBr). During lamp operation, an excimer radiation with a maximum of approximately 172 nm is produced with the aid of the xenon, and an excimer radiation with a maximum of approximately 222 nm is produced with the aid of KrCl, for example.

DETAILED DESCRIPTION OF THE DRAWINGS

Figure 1A:
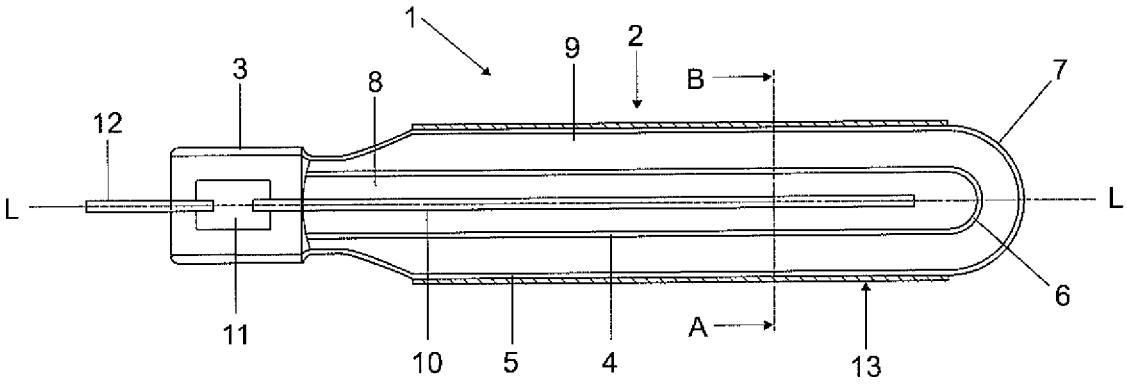
FIG. 1*a* shows an illustration of a longitudinal section through a dielectric barrier discharge lamp according to an embodiment of the invention.
Figure 1B:
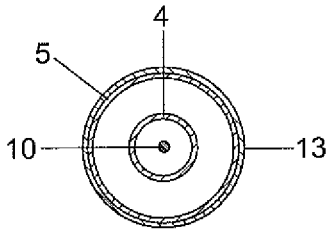
FIG. 1*b* shows a cross-sectional illustration of the lamp shown in FIG. 1*a*.

FIGS. 1*a* and 1*b* show a longitudinal section and a cross section, respectively, along the section line AB of a tubular dielectric barrier discharge lamp 1 in a schematic illustration. The lamp 1 is provided as a UV emitter in particular for sterilization in particular of different microorganisms in vegetative and sporulated form of conventional containers in the foodstuffs sector. In order to make it possible to insert the lamp into the corresponding container, the outer diameter of the lamp is selected to be smaller than the diameter of the container opening in question.

The dielectric barrier discharge lamp 1 has a tubular discharge vessel 2 with a longitudinal axis L, with a film-like pinch seal 3 adjoining one end of said discharge vessel. The discharge vessel 2 comprises substantially two tubular bulbs 4, 5 consisting of quartz glass Suprasil® 310 (from Heraeus). The diameter of the first bulb 4 is 10 mm, and that of the second bulb 5 is 16 mm. The first bulb 4 is arranged coaxially within the second bulb 5. The two bulbs are sealed at one of their ends with the aid of a dome-like cap 6, 7 and at the other end by means of the film-like pinch seal 3. The interior of the first tubular bulb 4 defines a first discharge space 8, which is sealed with xenon at a pressure of 250 mbar. The intermediate space between the outer side of the first bulb 4 and the inner side of the second bulb 5 defines the second discharge space, which is filled with KrCl (krypton with 0.5% chlorine) at a pressure of 250 mbar. A first rod-shaped electrode 10 consisting of molybdenum with a diameter of 1 mm is arranged coaxially within the first bulb 4. Said electrode is welded to one end of a molybdenum film 11, the molybdenum film 11 being pinched in a gas-tight manner in the film-like pinch seal 3. A molybdenum pin 12 is welded to the other end of the molybdenum film 11 and forms the outer power supply line for the inner first electrode 10. An outer, second electrode 13 consisting of a wire mesh with a mesh width of 2 mm is arranged on the outer side of the wall of the second bulb 5 (only illustrated in very schematized form). As an alternative to the wire mesh, a helical spring wire (for example with a diameter of 0.45 mm) with a pitch of 3 mm, for example, or a few conductor tracks with a width of approximately 1 to 2 mm which are applied equidistantly and longitudinally onto the outer side of the second bulb 5 can also be used (not illustrated). The effective lamp length, i.e. along which the outer electrode 13 extends, is approximately 350 mm.

The dielectric barrier discharge lamp 1 is operated using a high-voltage source (not illustrated). Effective discharge is achieved during pulsed operation in accordance with the document U.S. Pat. No. 5,604,410 mentioned at the outset at approximately 5 kV and a frequency of 100 kHz. The high-voltage pulse is connected to the molybdenum pin 12 and consequently to the inner electrode 10.

Although the invention has been explained above using the example of a tubular lamp with two coaxially arranged bulbs, the invention is not restricted to only two separate discharge spaces. For example, the lamp according to the invention can also have three or more coaxially arranged bulbs.

We claim:

1. A dielectric barrier discharge lamp comprising:

a discharge vessel having a first discharge space and a second discharge space, the first and second discharge spaces being separated from one another, the first discharge space surrounding a first discharge medium, the second discharge space surrounding a second discharge medium, and the first and second discharge mediums being different from one another.

2. The dielectric barrier discharge lamp as claimed in claim 1, wherein the discharge vessel comprises a first vessel and a second vessel, the first vessel being arranged within the second vessel, the first discharge space being formed within the first vessel, and the second discharge space being formed between the first vessel and the second vessel.

3. The dielectric barrier discharge lamp as claimed in claim 1, further comprising:

a first electrode of a first polarity arranged within the first vessel.

4. The dielectric barrier discharge lamp as claimed in claim 3, further comprising:

a second electrode of a second polarity arranged on the wall of the discharge vessel.

5. The dielectric barrier discharge lamp as claimed in claim 1, wherein the dielectric barrier discharge lamp has an elongate shape and defines a lamp longitudinal axis, the first and second discharge spaces being arranged coaxially with respect to the lamp longitudinal axis.

6. The dielectric barrier discharge lamp as claimed in claim 3, wherein the first electrode is arranged in an elongate and axial manner within the first vessel.

7. The dielectric barrier discharge lamp as claimed in claim 4, wherein the second electrode comprises a plurality of elongate sub-electrodes arranged parallel to one another and at a mutual distance from one another on the wall of the discharge vessel.

8. The dielectric barrier discharge lamp as claimed in claim 4, wherein the second electrode consists of a wire mesh or a helical wire.

9. The dielectric barrier discharge lamp as claimed in claim 1, wherein one of the first and second discharge mediums comprises xenon.

10. The dielectric barrier discharge lamp as claimed in claim 1, wherein one of the first and second discharge mediums comprises a krypton halide.

11. The dielectric barrier discharge lamp as claimed in claim 1, wherein the dielectric barrier discharge lamp is tubular.

* * * * *